US006145958A

United States Patent [19]

Medin et al.

[11] Patent Number: 6,145,958

[45] Date of Patent: Nov. 14, 2000

[54] RECYCLING INK SOLVENT SYSTEM FOR INKJET PRINTHEADS

[75] Inventors: Todd R Medin, Vancouver; Alan Shibata, Camas, both of Wash.

[73] Assignee: Hewlett-Packard Company, Palo Alto, Calif.

[21] Appl. No.: 08/964,976

[22] Filed: Nov. 5, 1997

[51] Int. Cl.[7] ..... B41J 2/165

[52] U.S. Cl. ..... 347/33; 347/28

[58] Field of Search ..... 347/33, 28

[56] References Cited

U.S. PATENT DOCUMENTS

| | | | |
|---|---|---|---|
| 4,024,548 | 5/1977 | Alonso et al. . | |
| 4,306,245 | 12/1981 | Kasugayama et al. . | |
| 5,051,758 | 9/1991 | Markham | 347/28 |
| 5,216,450 | 6/1993 | Koitabashi et al. | 347/87 |
| 5,300,958 | 4/1994 | Burke et al. . | |
| 5,557,306 | 9/1996 | Fukushima et al. | 347/33 |
| 5,614,930 | 3/1997 | Osborne et al. | 347/33 |
| 5,905,514 | 5/1999 | Rhodes et al. | 347/33 |
| 5,907,335 | 5/1999 | Johnson et al. | 347/28 |

FOREIGN PATENT DOCUMENTS

| | | | |
|---|---|---|---|
| 602646-A2 | 6/1994 | European Pat. Off. | 347/33 |
| 0673772A1 | 9/1995 | European Pat. Off. | B41J 2/165 |
| 0714775A2 | 6/1996 | European Pat. Off. | B41J 2/165 |
| 30 42 998 | 7/1982 | Germany | 347/33 |
| 3042-998 | 7/1982 | Germany | 347/33 |
| 60030348 | 2/1985 | Japan | B41J 3/04 |
| 02011332 | 1/1990 | Japan | B41J 2/165 |
| 404141440 | 5/1992 | Japan | 347/33 |

*Primary Examiner*—N. Le
*Assistant Examiner*—Shih-wen Hsieh
*Attorney, Agent, or Firm*—Flory L. Martin

[57] ABSTRACT

A recycling ink solvent system cleans an inkjet printhead in an inkjet printing mechanism using a wiper that moves between a wiping position for cleaning ink residue from the printhead, a scraping position for scraping residue from the wiper, and a solvent application position. An ink solvent recycling member has a body and a scraper portion that scrapes ink residue from the wiper and an applicator portion that applies ink solvent to the wiper. The body is constructed of a porous material that is impregnated with the ink solvent, with the pores being selected to move the ink solvent under capillary action from the scraper portion toward the applicator portion, and to filter dissolved ink residue from the ink solvent. A method is also provided to clean an inkjet printhead using such a recycling member, along with an inkjet printing mechanism having such a recycling system.

35 Claims, 4 Drawing Sheets

RECYCLING INK SOLVENT SYSTEM FOR INKJET PRINTHEADS

FIELD OF THE INVENTION

The present invention relates generally to inkjet printing mechanisms, and more particularly to a recycling ink solvent system that filters and recycles an inkjet ink solvent that is used in conjunction with a wiper system for cleaning inkjet printheads.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Since these permanent or semi-permanent printheads carry only a small ink supply, they may be physically more narrow than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

There are a variety of advantages associated with these off-axis printing systems, but the permanent or semi-permanent nature of the printheads requires special considerations for servicing, particularly when wiping ink residue from the printheads, which must be done without any appreciable wear that could decrease printhead life. To accomplish this objective, use of an ink solvent has been proposed. In this proposed system, the ink solvent, a polyethylene glycol ("PEG") compound is stored in a porous medium such as a plastic or foam block in intimate contact with a reservoir, with this porous block having an applicator portion exposed in such a way that the elastomeric wiper can contact the applicator. This elastomeric wiper moves across the applicator to collect PEG, which is then wiped across the printhead to dissolve accumulated ink residue and to deposit a non-stick coating of PEG on the printhead face to retard further collection of ink residue. The wiper then moves across a rigid plastic scraper to remove dissolved ink residue and dirtied PEG from the wiper before beginning the next wiping stroke. The PEG fluid also acts as a lubricant, so the rubbing action of the wiper does not unnecessarily wear the printhead. Unfortunately, this proposed system uses many parts to accomplish this wiping routine, with multiple parts requiring multiple tooling costs, ordering, inventory tracking and assembly. Moreover, over the lifetime of the printer, the PEG ink solvent may need to be replenished to maintain optimum printhead servicing.

SUMMARY OF THE INVENTION

According to one aspect of the present invention, a recycling ink solvent system is provided for cleaning an inkjet printhead in an inkjet printing mechanism. The system includes a wiper and a platform that supports the wiper for movement between a wiping position for cleaning ink residue from the printhead, a scraping position for scraping ink residue from the wiper, and an application position. The system also includes an ink solvent recycling member that has a body and a scraper portion located to scrape ink residue from the wiper when the wiper is moved to the scraping position. The recycling member body being is constructed of a porous material impregnated with an ink solvent. The recycling member body also defines an applicator portion located to apply the ink solvent to the wiper when the wiper is moved to the application position.

According to one aspect of the present invention, an ink solvent recycling member is provided for recycling ink solvent used by a wiper to clean ink residue from an inkjet printhead in an inkjet printing mechanism. The recycling member has a body defining a scraper portion located to scrape ink residue from the wiper when the wiper is moved to a scraping position. The body is constructed of a porous material impregnated with an ink solvent. The body also defines an applicator portion located to apply the ink solvent to the wiper when the wiper is moved to an application position.

According to yet another aspect of the present invention, a method is provided for cleaning an inkjet printhead in an inkjet printing mechanism, including the steps of applying an ink solvent to a wiper, wiping ink residue from the printhead and dissolving a portion of said ink residue in the applied ink solvent. In a scraping step, the ink residue, and remaining ink solvent with ink residue dissolved therein, is scraped from the wiper onto a scraper portion of a recycling member of a porous material. In a recycling step, the ink solvent is recycled by moving the ink solvent through the porous material of the recycling member from the scraper portion of the recycling member to an applicator portion of the recycling member. While moving the ink solvent, in a filtering step, the dissolved ink residue is filtered from the ink solvent with the porous material.

According to a further aspect of the present invention, an inkjet printing mechanism may be provided with a recycling ink solvent system as described above.

An overall goal of the present invention is to provide an inkjet printing mechanism which prints sharp vivid images over the life of the printhead and the printing mechanism, particularly when using fast drying pigment or dye-based inks, and preferably when dispensed from an off-axis system.

Another goal of the present invention is to provide a recycling solvent system for cleaning printheads in an inkjet printing mechanism.

A further goal of the present invention is to provide a recycling solvent system for filtering an ink solvent for reuse in an inkjet printing mechanism.

Still another goal of the present invention is to provide a recycling solvent system for cleaning printheads in an inkjet printing mechanism, with the system having fewer parts that are easier to manufacture than earlier systems, and which thus provides consumers with a reliable, economical inkjet printing unit.

DETAILED DESCRIPTION OF A PREFERRED EMBODIMENT

Figure 1:
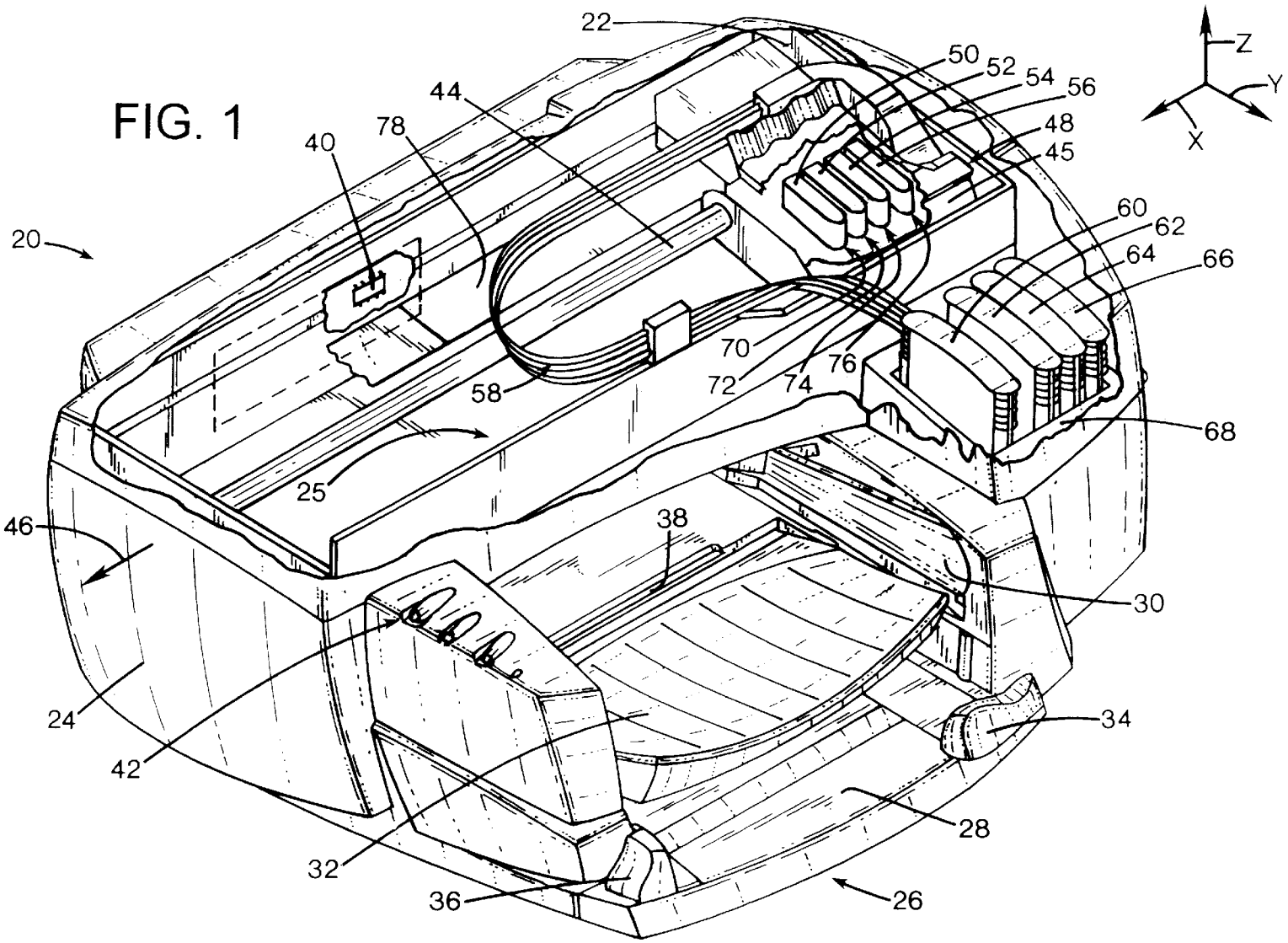
FIG. 1, is a perspective view of one form of an inkjet printing mechanism, here, an inkjet printer, including a printhead service station having one form of a recycling solvent system of the present invention for cleaning an inkjet printhead.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
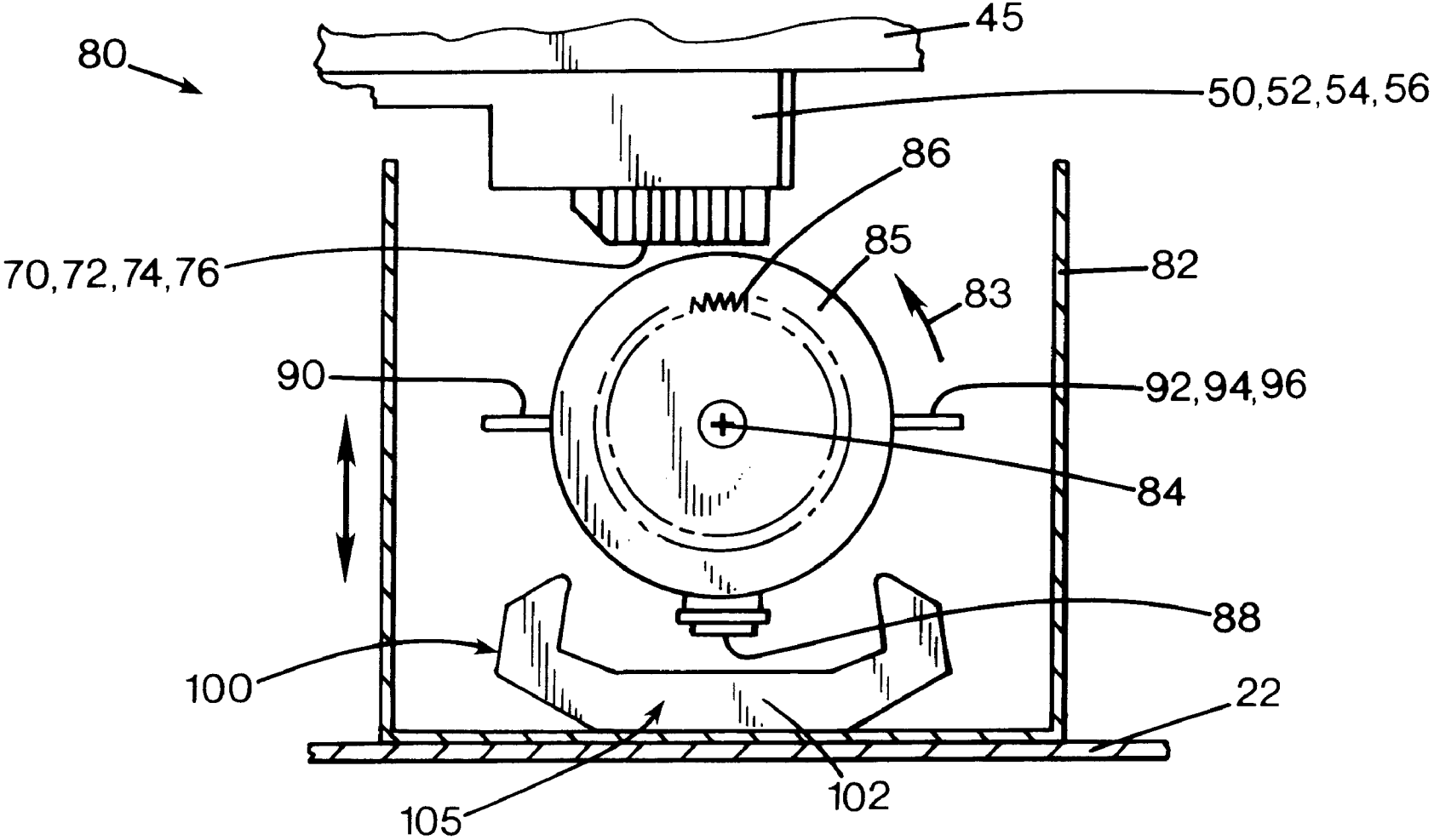
FIG. 2 is a side elevational view of the recycling solvent system of FIG. 1, shown cleaning an inkjet printhead.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

FIG. 2 illustrates one form of a recycling ink solvent service station 80 constructed in accordance with the present invention. The service station 80 includes a frame 82 which is supported by the printer chassis 22 in the servicing region 48 within the printer casing 24. To service the printheads 70–76 of the pens 50–56, the service station 80 includes a moveable platform supported by the service station frame 82. Here, the servicing platform is shown as a rotary member supported by bearings or bushings (not shown) at the service station frame 82 for rotation, as illustrated by arrow 83, about an axis 84, which in the illustrated embodiment is parallel with printhead scanning axis 46. The illustrated rotary member comprises a tumbler body 85 which may have a drive gear 86 that is driven by a conventional service station motor and drive gear assembly (not shown). The tumbler 85 carries a series of servicing components, such as a capping assembly 88, into position for servicing the printheads 70–76. The capping assembly 88 preferably includes four discrete caps for sealing each of the printheads 70–76, although only a single capping unit is visible in the view of FIG. 2. The tumbler 85 may also be mounted to the service station frame 82 for movement in a vertical direction, as indicated by the double-headed arrow in FIG. 2, to facilitate capping. Alternatively, the capping assembly 88 may be mounted to the tumbler 85 to move upwardly away from tumbler 85 when moved into contact with the pens 50–56 or the carriage 45, for instance, using the capping strategy first sold by the present assignee, Hewlett-Packard Company of Palo Alto, Calif., in the model 850C DeskJet® inkjet printer.

Other servicing components carried by the rotary platform 85 include a black printhead wiper 90 for servicing the black printhead 70, and three color wipers 92, 94 and 96 for servicing the respective color printheads 72, 74 and 76, although in the side view of FIG. 2, the yellow wiper 96 obscures the view of the cyan and magenta wipers 92, 94. Preferably, each of the wipers, 90–96 is constructed of a flexible, resilient, non-abrasive, elastomeric material, such as nitrile rubber, or more preferably, ethylene polypropylene diene monomer (EPDM), or other comparable materials known in the art. For wipers 90–96, a suitable durometer, that is, the relative hardness of the elastomer, may be selected from the range of 35–80 on the Shore A scale, or more preferably within the range of 60–80, or even more preferably at a durometer of 70±5, which is a standard manufacturing tolerance.

By placing the black wiper 90 along a different radial location on tumbler 85 than the radial on which the color wipers 92–96 are located, here, with the black and color wipers being shown 180° apart for the purposes of illustration, advantageously allows different wiping schemes to be employed for cleaning the black printhead 70 and for cleaning the color printheads 72–76. For instance, the color pens 52–56 carrying dye-based inks may be wiped using a faster wiping speed than required for wiping the black pen 50 which dispenses a black pigment-based ink. In the past, many service stations used wipers that required both the black and color printheads to be wiped simultaneously, so compromises had to be made between the optimum wiping speeds for the black pigment-based ink and the color dye-based inks. Problems were encountered in the past because the slower wiping strokes required to clean the black printheads extracted excess ink from the color printheads. When using a faster wiping stroke for the color pens, without allowing excess time for the color ink to seep out between the orifice plate and the wipers, the black wiper would then skip over black ink residue on the black printhead. These problems are avoided by service station 80, which places the black wiper 90 and the color wipers 92–96 at different locations around the periphery of the tumbler 85, thus allowing wiping to be optimized for both the black printhead 70 and for the color printheads 72–76. Moreover, separately wiping the black printhead 70 and the color printheads 72–76 requires less torque from the service station motor used to drive tumbler 85, so a more economical motor may be used.

As mentioned in the Background section above, the advent of permanent or semi-permanent inkjet printheads for use in off-axis printers, such as printer 20, particularly those using different types of ink, such as a pigment-based black ink and dye-based color inks, has proved challenging for service station designers. New servicing approaches were required to clean and maintain the pens to extend the life of the printheads. In studying various servicing routines, it was felt that use of an ink solvent may be the optimum approach to printhead cleaning. In particular, it would be even more desirable if the ink solvent also served to lubricate the printhead orifice plates during wiping, which would then avoid unnecessary wear or damage to the printheads, thereby insuring a long printhead life. Furthermore, it would also be desirable for the ink solvent to act as a non-stick coating, which when applied to the printhead, functions to repel ink accumulation. One such earlier wiping system, described in the Background section above, unfortunately requires a multitude of assembly parts, and may require replenishment of the solvent during the life of the printer 20.

To avoid these complications of excess assembly parts, and the need to refill the solvent system, FIG. 2 shows the recycling service station 80 as including an ink solvent recycling member or filter applicator member 100, constructed in accordance with the present invention. The recycling applicator member 100 has a body 102 which is supported by the service station frame 82, although a separate receptacle or container (not shown) may be used to mount the body 102 to the service station frame 82. Preferably, the applicator body 102 is made of a porous material, for instance, an open-cell thermoset plastic such as a polyurethane foam, a sintered polyethylene, or other functionally similar materials known to those skilled in the art.

Figure 3:
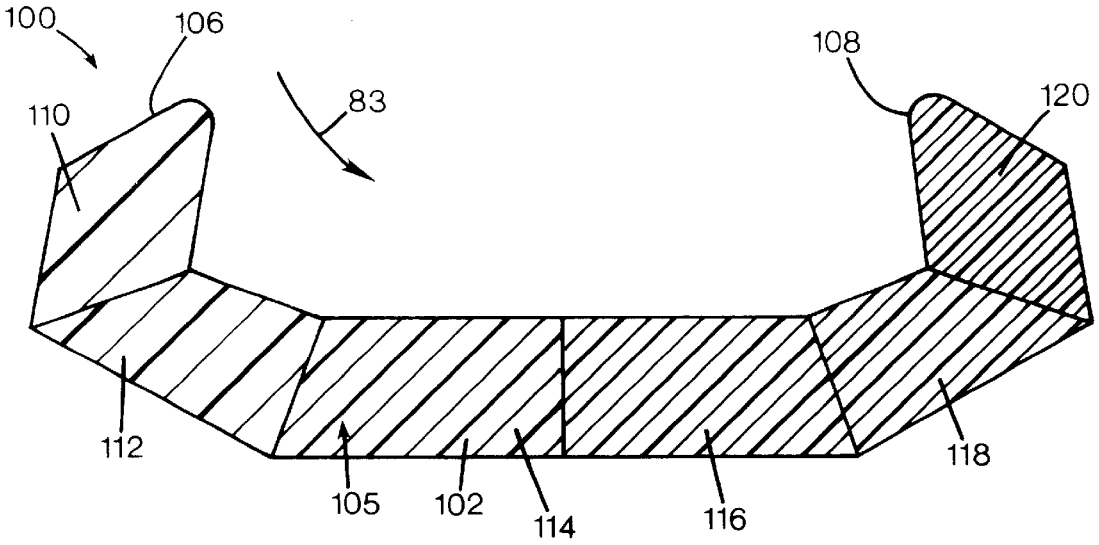
FIG. 3 is an enlarged sectional view of a recycling member of FIG. 2.
Figure 4:
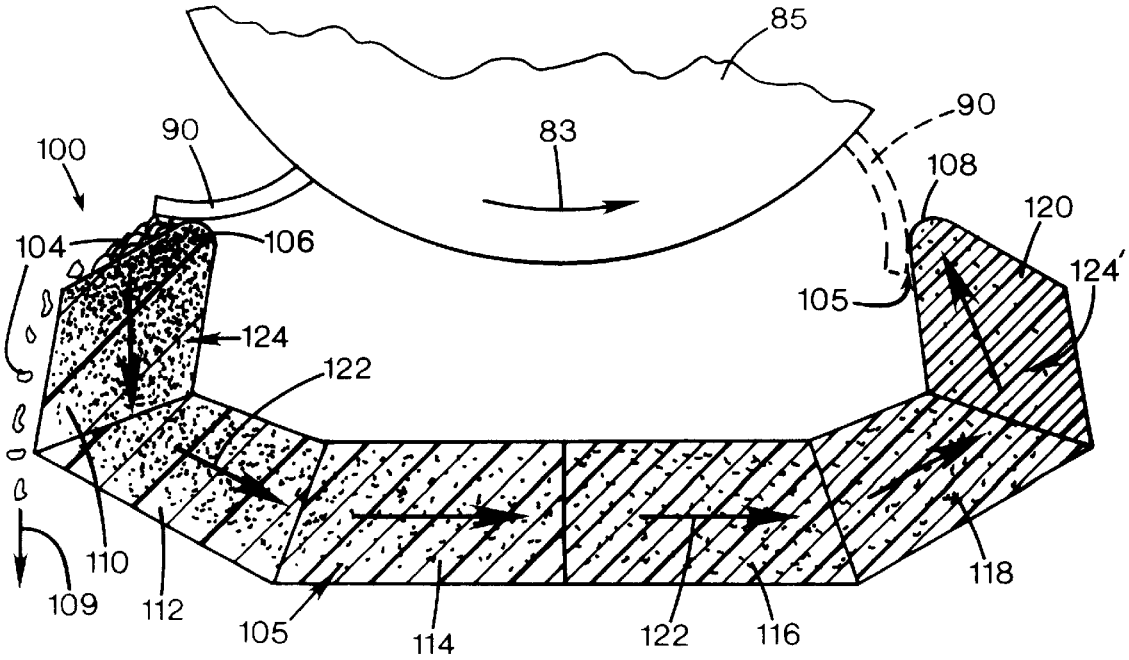
FIG. 4 is an enlarged sectional view of the recycling member of FIG. 2, shown with the wiper during a second phase of a wiping stroke in broken lines.

FIGS. 3 and 4 illustrate the recycling solvent applicator 100 in greater detail, with FIG. 4 also showing the tumbler platform 85 and one of the wipers for illustration, here, wiper 90. After stroking the printheads 70–76, ink residue is collected on the wipers 90–96, as illustrated by black ink residue 104 on wiper 90. Preferably, the recycling body 102 is impregnated or soaked with an inkjet ink solvent, preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the applicator body 102 is soaked with the preferred ink solvent, PEG 105.

In the illustrated embodiment, for use with wipers 90–96 mounted on the rotary platform 85, the body 102 has a roughly horseshoe-shaped configuration, with a residue depositing end or scraper 106 and a solvent applicator end 108. As shown in FIG. 4, any ink residue 104, as well as any excess PEG remaining on wiper 90 after cleaning the printhead 70, is deposited onto the surface of the scraper end 106. Some of this residue 104 may eventually flake off and fall toward the bottom of the spittoon frame 82, as illustrated schematically in FIG. 4 by arrow 109.

As illustrated from the varying thickness of the cross-hatching in FIGS. 3 and 4, the recycling body 102 is preferably composed of two or more different sections having different capillary pressures, here provided by different porosities. FIG. 3 shows the body 102 as having two or more sections of different densities, here illustrated by the spacings of the shading lines which are shown wider apart for the more porous material which has a lower capillary pressure, and more closely spaced as the pores become smaller in size where the body 102 has a higher capillary pressure. In the illustrated embodiment, the recycling body 102 is shown as having six sections or stages with increasing capillary pressures provided by decreasing pore sizes, here shown as segments or stages 110, 112, 114, 116, 118 and 120, with the first segment 110 being at the scraper end 106 having the coarsest pores, and the applicator end 108 being formed by the finest pore size at the last segment 120. The smaller diameter pore sizes encourage the ink solvent to flow under increasing capillary pressures as shown by arrows 122 in FIG. 4, from the first stage, coarsest pore segment 110 through subsequent stages 112, 114, 116, 118 and finally into the last stage 120, at the applicator end 108. This flow of the PEG ink solvent 105 is accomplished using a wicking action provided by capillary forces which draw the liquid solvent into increasingly smaller areas, here provided by the decreasing pore sizes of stages 110–120.

In FIG. 4, the stippled shading illustrates ink particles 124, which are carried by the PEG through body 102. As the PEG moves through body 102, the pigment particles become entrapped along the passageways connecting the pores of the segments 110–120, so body 102 functions as a filter that cleans the ink pigments or dye particles from the PEG solvent. This is shown by the stippling in FIG. 4 being fairly dense at the scrapper end 106 of segment 110, and then decreasing in density to be barely noticeable, shown as ink particles 124' in the final pore stage 120 at the applicator end 108. Thus, the recycling solvent applicator 100 serves to cleanse the PEG solvent of ink particles as the PEG travels via wicking or capillary action through body 102 from the scraper end 106 to the applicator end 108.

Moreover, the low ratio of pigment to solvent advantageously prevents the pigment particles from coagulation. The ink solvent 105 within body 102 advantageously redistributes the black pigment particles into a solution or suspension that stops the interlocking process for which these particles have an affinity. The illustrated pigment-based black ink is designed to form a sticky matrix as the ink dries to prevent the ink from "bleeding" by migrating into the fibers of the print media. Thus, these interlocking pigment particles produce printed images having crisp, sharp edges which is particularly important when printing black text. Furthermore, the liquid components of both the black and color inks also serve as ink solvents in addition to the PEG ink solvent 105 inside the body 102.

It is apparent that while the body 102 is illustrated for use with a rotary wiper system having wipers mounted on tumbler 85, the body 102 may be easily modified in shape to clean residue from the wipers and then apply PEG to wipers mounted on other types of servicing platforms, such as a translational or sliding platform, although the original design was conceived for the rotary wiping system illustrated in the drawings. Indeed, rather than mounting the recycling member 100 along the bottom surface of the service station frame 82, in other embodiments it may be more preferable to mount the recycling member 100 along the side of an upright wall. Alternatively, the recycling member 100 may be suspended from a ceiling portion of a service station frame or support, with the wipers then moving underneath the recycling member 100 for scraping and application of the ink solvent 105, which is quite practicable because the preferred ink solvents have a surface tension so that when embedded in the recycling member 102, the capillary pressure will not allow the solvent 105 to drain out, even when upside-down from the views of FIGS. 3 and 4. It is also apparent that for the purposes of illustration, the filter body 102 has been shown as a symmetrically shaped member, it may prove advantageous to construct the scraper end 106 to have a different configuration than the applicator end 108, which could aid in ease of assembly, and prevent mis-assembly of the applicator body 102 into the service station frame 82.

While only the black wiper 90 is illustrated as being cleaned in FIG. 4, it is apparent that the body 102 is preferably a unitary member extended in width across the printer 20 (parallel to the scanning axis 46, and here in FIG. 4, into the plane of the drawing sheet) to also scrape and apply solvent 105 to the color wipers 92–96. alternatively, it may prove beneficial to have four separate solvent recycling bodies 102, one for each wiper 90, 92, 94 and 96. In another embodiment, it may be preferable to have two recycling bodies, one for the black pigment-based ink wiper 90, and the other body 102 for all of the color dye-based ink wipers 92–96.

While six varying porosity segments 110–120 are shown for wiper body 102, it may be more preferable to have a single segment with gradually decreasing pore size. Alternatively, it may be preferable to have fewer segments, such as only two or three segments, or to have segments varying in length and in cross sectional areas. For instance, it may prove advantageous to have the scraper end first segment 110 be of a larger volume to provide a longer path for greater coarse filtering capability, with a smaller volume intermediate section to more rapidly move the solvent toward the final finest-pore segment at the applicator end 108. Alternatively, a coarse initial section may in some embodiments be relatively a short path for the PEG to flow through, with a longer intermediate section for PEG travel and smaller-sized ink particle filtering. Thus, by controlling the pore size and the volume of each segment, the speed of solvent travel through the body 102 may be adjusted. Other adjustments may be made to the body segments to not only control speed of flow, but to also control various filtering aspects of the body 102. For instance, when using different types of inks, coarser particulate matter from one ink type may be collected in one of the first stages, while finer ink particles from another type of ink being collected in one of the later, smaller-pore stages.

Other variations may be made to body 102 to vary the filtering and flow performance aspects of the solvent recycling system 100. For instance, a screen of a well-defined pore size may be insert-molded into the body 102 to more tightly control the filtering aspects of body 102. Such an insert-molded screen could be of a metal or a plastic, or a pierced member, or a woven or non-woven fabric. As another example, in a preferred embodiment the body 102 may be constructed of a high density polyethylene (HDPE) which is plasma-treated to have an affinity with PEG solvent 105. This plasma treatment process may be controlled to adjust the body's capillary gradient to change the wetting angle through the recycling system 100.

In plasma treating, the entire body 102 is placed in a pressure-controlled cavity wherein the residing air is substantially evacuated, after which a gas is added to the cavity and a high frequency voltage is applied to the cavity. This high frequency voltage turns the gas into a plasma which then changes the surface chemistry of the solid by replacing some HDPE atoms with atoms from the gas. Through this plasma treatment process, the surface energy of the plastic can be drastically altered, and in the illustrated embodiment, this surface energy is raised, resulting in a smaller wetting angle, which in turn yields a larger capillary pressure. Typical gas additives are nitrous oxide, oxygen, or helium. Following this plasma treating process, the ink solvent 105 may be impregnated within the body 102 through immersion within liquid solvent 105. Alternatively, the body 102 may be force-filled with ink solvent 105 by drawing a vacuum through these components to eliminate air within the pores, followed by introduction of the ink solvent, which would eliminate the need for plasma treating.

Figure 5:
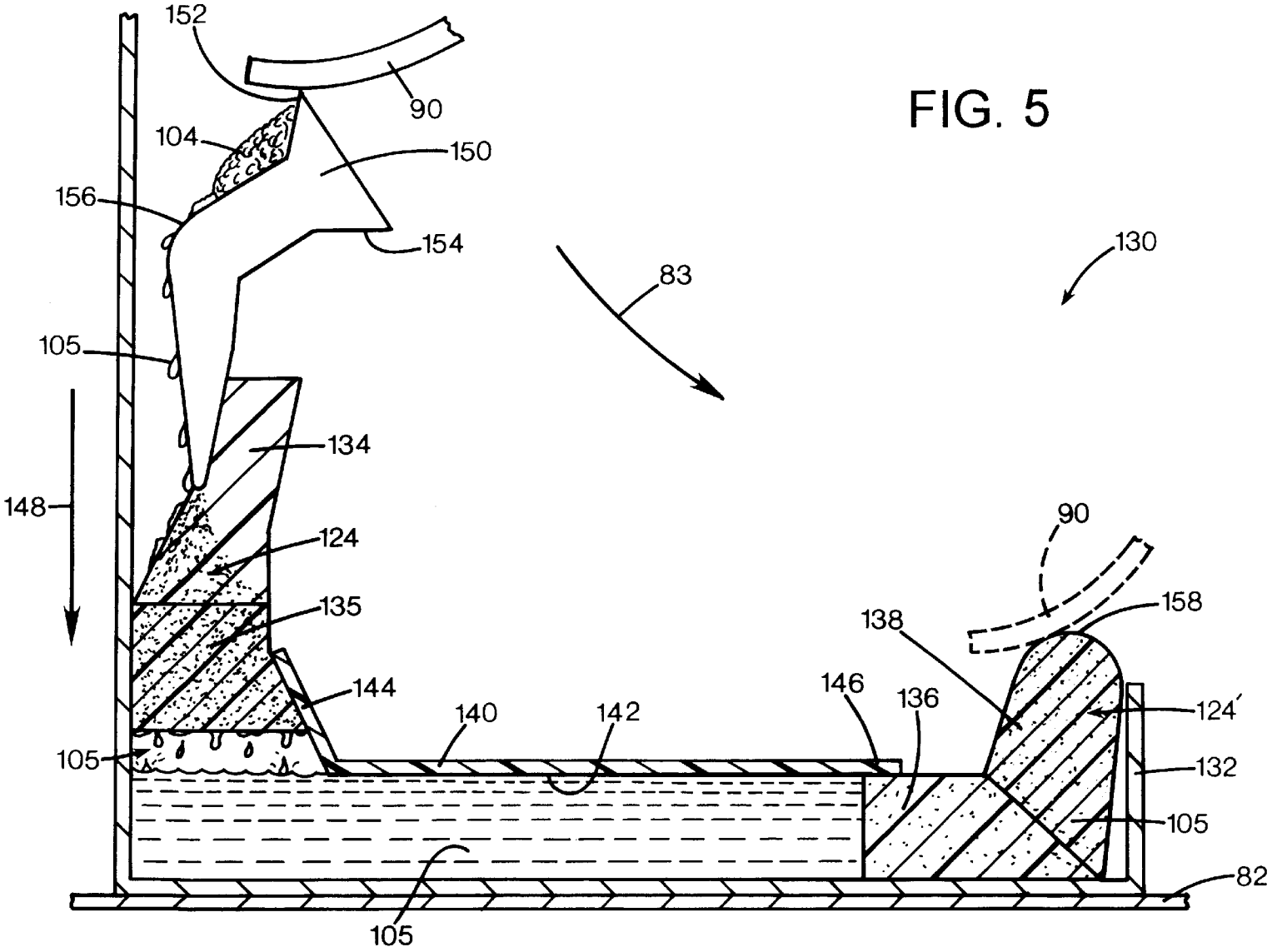
FIG. 5 is an enlarged, sectional, elevational view of an alternate form of a recycling member of the present invention for use in the printing mechanism of FIG. 1.

FIG. 5 shows an alternate embodiment of an ink solvent recycling member or filter applicator member 130, constructed in accordance with the present invention, for use in recycling service station 80. Actually, FIG. 5 shows several concepts which may be used altogether as shown, or which may be employed separately. Specifically FIG. 5 illustrates the concepts of (1) a separate scraper member, (2) a reservoir containing a liquid pool of solvent, (3) and the use of gravity feed in addition to capillary pressure to draw the solvent from the scraper entrance end to the applicator exit end.

The recycling applicator member 130 has a frame 132, which is supported by the service station frame 82, and a segmented body preferably made of the same type of porous material described above for body 102. The first part of this recycling body is located at an entrance to member 130, and includes a first stage 134 followed by a second stage 135 having a pore size smaller than stage 134. The second part of the segmented recycling body is located at an exit or applicator end of member 130, and includes an intermediate stage 136 and a final stage 138 which has a pore size smaller than stage 134.

A container 140 defines a reservoir chamber 142 therein, as well as an inlet port 144 and an outlet port 146. The reservoir 142 contains a supply of liquid ink solvent 105. The container inlet port 144 receives the second stage 135 of the recycling body, while the outlet port 146 receives the intermediate stage 136 of the body. Thus, the container 140 fluidically couples the entrance portions 134, 135 of the recycling body to the exit portions 136, 138 for fluid flow through capillary pressure from the first stage 134 to the final stage 138. By elevating the first stage 134 above the second stage 135, the force of gravity, illustrated by arrow 148, advantageously assists in promoting fluid flow through the stages 134 and 135, in addition to the flow provided by capillary pressure from the difference in pore sizes between stages 134 and 135.

The recycling applicator member 130 also has a scraper portion, here shown as a rigid scraper 150 with a first scraper edge 152 for cleaning the wipers 90–96 when rotated by tumbler 85 in the direction of arrow 83. The scraper 150 has a second scraper edge 154 to clean the other surface of the wiper blade if desired, when the tumbler 85 is rotated in a direction opposite to arrow 83. Scraped ink residue 104 is shown along a drain surface 156 of the scraper 150, with droplets of ink solvent 105 shown dropping under the force of gravity 148 onto the first stage 134. The relative shading and stippling of the body segments 134–138 represents the variations in pore sizes and the relative amounts ink 124, 124' within the stages 134–138, as described above with respect to FIG. 4. As the solvent 105 travels through the recycling member 130, initial filtering of ink occurs in stages 134 and 135, with the solvent 105 exiting stage 135 shown dripping under the force of gravity 148 into the solvent pool within the reservoir 142. Capillary forces draw the solvent 105 from the reservoir 142 into the intermediate stage 136, then into the final stage 138, which forms an applicator portion 158 of member 130. The wiper 90 is shown in dashed lines receiving ink solvent 105 from the applicator 158, beginning a new wiping stroke sequence.

CONCLUSION

Thus, the recycling ability of solvent applicator 100 serves to preserve and clean PEG within the service station 80, and prolong the life of the service station 80 without requiring unnecessary refilling of the ink solvent 105 during the lifespan of the printer 20. Furthermore, the filter applicator 100 advantageously allows clean ink solvent 105 to be readily available at the applicator end 108 for subsequent wiping strokes, as the capillary action of body 102 continually draws the solvent 105 through the body 102 toward the applicator end 108. As a further advantage, the solvent applicator 100 advantageously provides several functions which required separate parts in previously proposed designs, here acting (1) as a wiper cleaner at the scraper end 106, (2) as a storage body or reservoir for the ink solvent 105, (3) as a solvent applicator 108, and finally (4) as a solvent recycling cleaner or filter, all accomplished within a single part. Thus, use of the applicator I 00 advantageously expedites assembly of the printer 20, while reducing the number of parts required to assemble the service station 80, which provides consumers with a more economical printer product 20.

What is claimed is:

1. A recycling ink solvent system for cleaning an inkjet printhead in an inkjet printing mechanism, comprising:

a wiper;

a platform which supports the wiper for movement through an application stroke, a wiping stroke for cleaning ink residue from the printhead, and a scraping stroke; and an ink solvent recycling apparatus having a body of a porous material impregnated with an ink solvent, with the body defining an applicator portion which applies the ink solvent to the wiper during the application stroke to dissolve therein ink residue gathered during the wiping stroke, with the recycling apparatus also having a scraper portion which scrapes the solvent with the ink residue dissolved therein from the wiper during the scraping stroke, wherein solvent with the ink the residue dissolved therein is transferred from the scraper portion to the applicator portion by the porous material of the body while recycling the solvent by removing dissolved ink residue therefrom and wherein the scraper portion comprises a rigid member having a scraper blade which receives ink residue from the wiper and a drain surface that directs ink solvent from the scraper blade to the recycling apparatus body.

2. A recycling ink solvent system according to claim 1 wherein the porous material of the recycling apparatus body has pores varying in size from the scraper portion to the applicator portion which are sized to move the ink solvent under capillary pressure through the body toward the applicator portion.

3. A recycling ink solvent system according to claim 1 wherein the porous material of the recycling apparatus body has pores sized to filter the dissolved portion of the ink residue from the ink solvent.

4. A recycling ink solvent system according to claim 3 wherein the porous material of the recycling apparatus body has pores varying in size from the scraper portion to the applicator portion which are sized to move the ink solvent under capillary pressure through the body toward the applicator portion.

5. A recycling ink solvent system according to claim 1 wherein the porous material of the recycling apparatus body is arranged in plural stages, with each stage progressively located from the scraper portion to the applicator portion having pores of a size smaller than the pores of the immediately preceding stage.

6. A recycling ink solvent system according to claim 5 wherein the pore size and volume of one stage of said plural stages are selected to move the ink solvent more quickly through said one stage than through another of said plural stages.

7. A recycling ink solvent system according to claim 5 wherein the pore size and volume of one stage of said plural stages are selected to filter more of the dissolved portion of the ink residue from the ink solvent than filtered by another of said plural stages.

8. A recycling ink solvent system according to claim 1 wherein the body of the ink solvent recycling apparatus is configured to define the scraper portion.

9. A recycling ink solvent system according to claim 1 further including a container defining a reservoir between the scraper portion and the applicator portion of the body, with the reservoir containing a supply of ink solvent.

10. A recycling ink solvent system according to claim 1 wherein the scraper portion is located above the applicator portion of the body to use the force of gravity to promote solvent flow from the scraper portion to the applicator portion.

11. A recycling ink solvent system according to claim 10 wherein the body of the ink solvent recycling apparatus is configured to define the scraper portion.

12. A method of cleaning an inkjet printhead in an injet printing mechanism, comprising the steps of:

applying an ink solvent to a wiper;

wiping ink residue from the printhead and dissolving a portion of said ink residue in the applied ink solvent;

scraping said ink residue and remaining ink solvent with ink residue dissolved therein from the wiper onto a scraper portion of a recycling member of a porous material, wherein the scraper portion comprises a rigid apparatus having a scraper blade, which receives ink residue from the wiper, and a drain surface;

directing ink solvent from the scraper blade to the recycling member with the drain surface; and recycling the ink solvent by moving the ink solvent through the porous material of the recycling member from the scraper portion of the recycling member to an applicator portion of the recycling member, and during said moving of the ink solvent, filtering said dissolved ink residue from the ink solvent with the porous material.

13. A method according to claim 12 wherein the applying step comprises applying filtered ink solvent to the wiper with the applicator portion of the recycling member.

14. A method according to claim 12 wherein the step of moving of the ink solvent comprises moving the ink solvent through capillary pressure provided by the porous material of the recycling member.

15. A method according to claim 12 wherein:

the recycling member comprises plural stages each of a different porosity, with one of said plural stages comprising a first stage having pores of a first size and defining the scraper portion, and with another of said plural stages comprising a last stage having pores of a second size smaller than said first size, and with said last stage defining the applicator portion; and the step of moving of the ink solvent comprises moving the ink solvent from the first stage to the last stage through capillary action provided by said different porosities of said plural stages of the recycling member.

16. A method according to claim 15 wherein:

an additional one of said plural stages comprising an intermediate stage having pores of an intermediate size between said first and second sizes of pores, and with said intermediate stage being located between said first and last stages; and the step of moving of the ink solvent comprises moving the ink solvent from the first stage, through the intermediate stage, and to the last stage through said capillary action.

17. A method according to claim 12, further including the step of controlling the speed of the movement of the ink solvent in said moving step by selecting pores of the porous material to be of a selected size.

18. A method according to claim 12, further including the step of controlling the speed of the movement of the ink solvent in said moving step by selecting a length of travel of the solvent between the scraper portion to the applicator portion of the recycling member.

19. A method according to claim 12, further including the step of controlling the speed of the movement of the ink solvent in said moving step by selecting the geometry of the recycling member.

20. An inkjet printing mechanism, comprising:

an inkjet printhead;

a carriage that reciprocates the printhead through a print-zone for printing and to a servicing region for printhead servicing;

a wiper;

a platform that supports the wiper for movement through an application stroke, a wiping stroke for cleaning ink residue from the printhead when in the servicing region, and a scraping stroke; and an ink solvent recycling apparatus having a body of a porous material impregnated with an ink solvent, with the body defining an applicator portion which applies the ink solvent to the wiper during the application stroke to dissolve therein ink residue gathered during the wiping stroke, with the recycling apparatus also having a scraper portion which scrapes the solvent with the ink residue dissolved therein from the wiper during the scraping stroke, wherein solvent with the ink the residue dissolved therein is transferred from the scraper portion to the applicator portion by the porous material of the body while recycling the solvent by removing dissolved ink residue therefrom, and wherein the scraper portion comprises a rigid apparatus having a scraper blade that receives ink residue from the wiper and a drain surface that directs ink solvent from the scraper blade to the recycling apparatus body.

21. An inkjet printing mechanism according to claim 20 wherein the porous material of the recycling apparatus body has pores varying in size from the scraper portion to the applicator portion which are sized to move the ink solvent under capillary pressure through the body toward the applicator portion.

22. An inkjet printing mechanism according to claim 20 wherein the porous material of the recycling apparatus body has pores sized to filter the dissolved portion of the ink residue from the ink solvent.

23. An inkjet printing mechanism according to claim 20 wherein the porous material of the recycling apparatus body is arranged in plural stages, with each stage progressively located from the scraper portion to the applicator portion having pores of a size smaller than the pores of the immediately preceding stage.

24. An inkjet printing mechanism according to claim 20 wherein the body of the ink solvent recycling apparatus is configured to define the scraper portion.

25. An inkjet printing mechanism according to claim 20 further including a container defining a reservoir between the scraper portion and the applicator portion of the body, with the reservoir containing a supply of ink solvent.

26. An inkjet printing mechanism according to claim 20 wherein the scraper portion is located above the applicator portion of the body to use the force of gravity to promote solvent flow from the scraper portion to the applicator portion.

27. An inkjet printing mechanism according to claim 26 wherein the body of the ink solvent recycling apparatus is configured to define the scraper portion.

28. An ink solvent recycling apparatus for recycling ink solvent used by a wiper to dissolve therein ink residue wiped from an inkjet printhead in an inkjet printing mechanism, comprising:

a body of a porous material impregnated with said ink solvent, with the body defining an applicator portion located to apply the ink solvent to the wiper to dissolve therein ink residue gathered when wiping the printhead; and a scraper portion located to scrape the solvent with the ink residue dissolved therein from the wiper after wiping the printhead;

wherein the porous material of the body transfers the solvent with the ink the residue dissolved therein from the scraper portion to the applicator portion while recycling the solvent by removing dissolved ink residue therefrom, wherein the scraper portion comprises a rigid apparatus having a scraper blade that receives ink residue from the wiper and a drain surface that directs ink solvent from the scraper blade to the body.

29. An ink solvent recycling apparatus according to claim 28 wherein the porous material of the recycling apparatus body has pores varying in size from the scraper portion to the applicator portion which are sized to move the ink solvent under capillary pressure through the body toward the applicator portion.

30. An ink solvent recycling apparatus according to claim 28 wherein the recycling apparatus comprises plural stages each of a different porosity, with one of said plural stages comprising a first stage having pores of a first size and defining the scraper portion, and with another of said plural stages comprising a last stage having pores of a second size smaller than said first size, and with said last stage defining the applicator portion.

31. An ink solvent recycling apparatus according to claim 30 wherein an additional one of said plural stages comprises an intermediate stage having pores of an intermediate size between said first and second sizes of pores, and with said intermediate stage being located between said first and last stages.

32. An ink solvent recycling apparatus according to claim 30 wherein the pore size and volume of one stage of said plural stages are selected to move the ink solvent more quickly through said one stage than through another of said plural stages.

33. An ink solvent recycling apparatus according to claim 30 wherein the pore size and volume of one stage of said plural stages are selected to filter more ink residue from the ink solvent than filtered by another of said plural stages.

34. An ink solvent recycling apparatus according to claim 28 wherein the body is configured to define the scraper portion.

35. An ink solvent recycling apparatus according to claim 28 further including a container defining a reservoir between the scraper portion and the applicator portion of the body, with the reservoir containing a supply of ink solvent.

* * * * *